US011209176B2

(12) United States Patent
Ma et al.

(10) Patent No.: US 11,209,176 B2
(45) Date of Patent: Dec. 28, 2021

(54) THERMOELECTRIC DEHUMIDIFIER

(71) Applicants: Hongbin Ma, Columbia, MO (US); Willard Hanson, Columbia, MO (US); Zaichun Feng, Columbia, MO (US)

(72) Inventors: Hongbin Ma, Columbia, MO (US); Willard Hanson, Columbia, MO (US); Zaichun Feng, Columbia, MO (US)

(73) Assignee: THE CURATORS OF THE UNIVERSITY OF MISSOURI, Columbia, MO (US)

( * ) Notice: Subject to any disclaimer, the term of this patent is extended or adjusted under 35 U.S.C. 154(b) by 154 days.

(21) Appl. No.: 15/966,566

(22) Filed: Apr. 30, 2018

(65) Prior Publication Data

US 2018/0313553 A1 Nov. 1, 2018

Related U.S. Application Data

(60) Provisional application No. 62/491,613, filed on Apr. 28, 2017.

(51) Int. Cl.

| | |
|---|---|
| ***F25B 21/02*** | (2006.01) |
| ***F24F 3/14*** | (2006.01) |
| ***F24F 13/22*** | (2006.01) |
| ***F24F 5/00*** | (2006.01) |
| ***F28D 15/02*** | (2006.01) |

(52) U.S. Cl.

CPC ..... *F24F 3/14* (2013.01); *F24F 5/0042* (2013.01); *F24F 13/222* (2013.01); *F25B 21/02* (2013.01); *F28D 15/0275* (2013.01); *F24F 2003/1446* (2013.01); *F25B 2321/0251* (2013.01); *F28D 15/02* (2013.01)

(58) Field of Classification Search

CPC ..... F24F 3/14; F24F 5/0042; F24F 13/222; F24F 2003/1446; F28D 15/0275; F28D 15/02; F25B 21/02; F25B 2321/0251; F25B 2321/025

See application file for complete search history.

(56) References Cited

U.S. PATENT DOCUMENTS

| | | | | |
|---|---|---|---|---|
| 4,586,342 A * | 5/1986 | Morishita | F25B 21/02 62/3.4 |
| 8,763,408 B2 | 7/2014 | Ma et al. | |
| 8,973,383 B2 * | 3/2015 | Sakami | F24F 3/14 62/176.6 |
| 10,101,059 B2 * | 10/2018 | Ma | F25B 15/02 |

FOREIGN PATENT DOCUMENTS

WO WO-2013162191 A1 * 10/2013 ..... F24F 5/0042

* cited by examiner

*Primary Examiner* — David J Teitelbaum
(74) *Attorney, Agent, or Firm* — Sandberg Phoenix and von Gontard

(57) ABSTRACT

A high efficiency, low noise thermoelectric dehumidifier that includes a heat pipe array, a condensing heat sink, an air intake duct, and a thermoelectric cooler. A first air flow is directed over the condensing heat sink that is cooled by the thermoelectric cool such that the first air flow is dehumidified by the cooled condensing heat sink. Heat is removed from a hot side of the thermoelectric cooler via the heat pipe array. A second air flow is directed over the heat pipe array such that the heat extracted from the hot side of the thermoelectric cooler is extracted and circulated back into the ambient environment.

12 Claims, 4 Drawing Sheets

THERMOELECTRIC DEHUMIDIFIER

CROSS-REFERENCE TO RELATED APPLICATIONS

This application claims the benefit of U.S. Provisional Application No. 62/491,613, filed on Apr. 28, 2017. The disclosure of the above application is incorporated herein by reference in its entirety.

FIELD

The present teachings relate to dehumidifiers, and more particularly to a high efficient dehumidifier.

BACKGROUND

The statements in this section merely provide background information related to the present disclosure and may not constitute prior art.

Typical known dehumidifier systems can generally be categorized into two types of systems. A first type of system is a compressor based dehumidifier system and a second type is a thermoelectric cooler based dehumidifier system. The compressor based systems are designed to utilize a refrigeration cycle and need a compressor to dehumidify the air. However, due to compressor noise, the compressor based dehumidifier systems are not operable in low noise environments. The thermoelectric cooler based systems employ a thermoelectric cooler to generate cooling and produce a condensation surface to remove moisture from the ambient air. Although the thermoelectric cooler based systems can reduce noise level, the capacity and efficiency of such systems to remove moisture from ambient air is very low. Hence, known dehumidifier systems are typically inefficient and/or noisy.

SUMMARY

The present disclosure generally provides highly efficient thermoelectric dehumidifier that operates at a low noise level.

The present disclosure generally provides a high efficiency, low noise thermoelectric dehumidifier. In various embodiments, the dehumidifier can include at least one heat pipe array, at least one condensing heat sink, an air intake duct, a condensation pan, a condenser fan, and at least one thermoelectric cooler. The condenser fan is structured and operable to draw a first air flow from an ambient environment that surrounds the dehumidifier into an inlet of the air intake duct. The air intake duct is structured and operable to direct the first air flow toward the condensing heat sink such that the first air flow passes over, through and/or across the condensing heat sink. The thermoelectric cooler comprises a cooling side that is in thermally conductive contact with the at least one condensing heat sink such that the first air flow is cooled and moisture in the first air flow will condense as the first air flow passes over, through and/or across the condensing heat sink and fall into the condensation pan, thereby dehumidifying the first air flow. The condenser fan will further circulate the cooled and dehumidified first air flow back into the ambient environment. The thermoelectric cooler additionally comprises a hot side that is in thermally conductive contact with the heat pipe array(s) such that heat generated by the thermoelectric cooler is extracted from the hot side by the heat pipe array(s). The dehumidifier further comprises an extractor fan that is structured and operable to draw a second air flow from the ambient environment and direct the second air flow over, through and/or across the heat pipe array(s) such that the heat extracted from the hot side of the thermoelectric cooler by the heat pipe array(s) is extracted from the heat pipe array(s) and circulated back into the ambient environment.

In various instances, the air intake duct can be structured to provide a cooling recover unit that is operable to direct the cooled and dehumidified air across a flow path of the first air flow as it is being drawn into the air intake duct from the ambient environment such that as the first air flow is being drawn into the air intake duct from the ambient environment it will be pre-cooled by cooled, dehumidified air prior to flowing over, through and/or across the condensing heat sink.

In various instances, at least one thermoelectric cooler is can be an ejector-thermoelectric cooler.

This summary is provided merely for purposes of summarizing various example embodiments of the present disclosure so as to provide a basic understanding of various aspects of the teachings herein. Various embodiments, aspects, and advantages will become apparent from the following detailed description taken in conjunction with the accompanying drawings which illustrate, by way of example, the principles of the described embodiments. Accordingly, it should be understood that the description and specific examples set forth herein are intended for purposes of illustration only and are not intended to limit the scope of the present teachings.

DRAWINGS

The drawings described herein are for illustration purposes only and are not intended to limit the scope of the present teachings in any way.

Corresponding reference numerals indicate corresponding parts throughout the several views of drawings.

DETAILED DESCRIPTION

Figure 1:
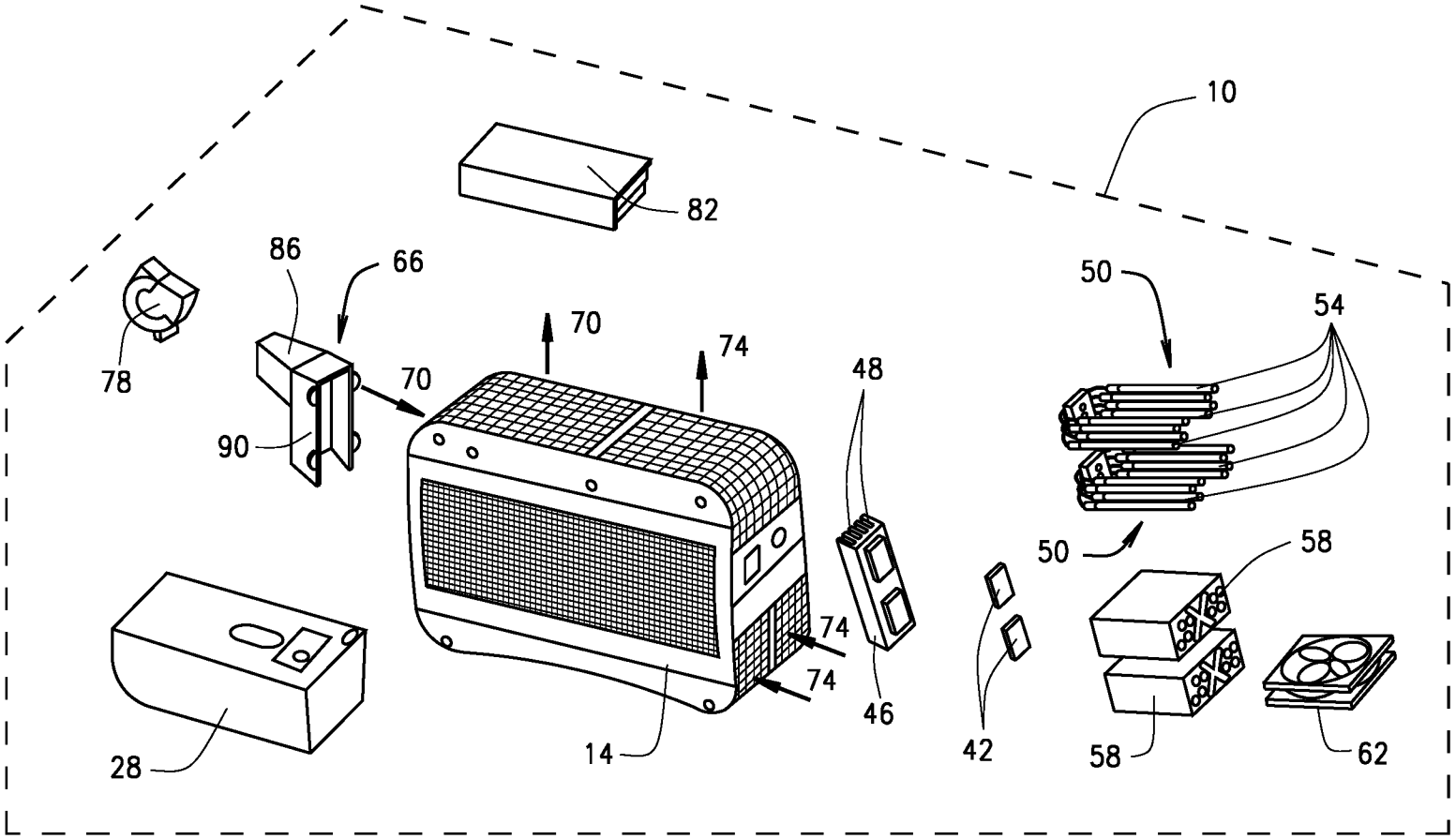
FIG. 1 is an exploded illustration of a high efficiency, low noise thermoelectric dehumidifier, in accordance with various embodiments of the present disclosure.

The following description is merely exemplary in nature and is in no way intended to limit the present teachings, application, or uses. Throughout this specification, like reference numerals will be used to refer to like elements. Additionally, the embodiments disclosed below are not intended to be exhaustive or to limit the invention to the precise forms disclosed in the following detailed description. Rather, the embodiments are chosen and described so that others skilled in the art can utilize their teachings. As well, it should be understood that the drawings are intended to illustrate and plainly disclose presently envisioned embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims.

Unless otherwise defined, all technical and scientific terms used herein have the same meaning as commonly understood by one of ordinary skill in the art to which this disclosure belongs. The terminology used herein is for the purpose of describing particular example embodiments only and is not intended to be limiting. As used herein, the singular forms "a," "an," and "the" may be intended to include the plural forms as well, unless the context dearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps can be employed.

When an element, object, device, apparatus, component, region or section, etc., is referred to as being "on," "engaged to or with," "connected to or with," or "coupled to or with" another element, object, device, apparatus, component, region or section, etc., it can be directly on, engaged, connected or coupled to or with the other element, object, device, apparatus, component, region or section, etc., or intervening elements, objects, devices, apparatuses, components, regions or sections, etc., can be present. In contrast, when an element, object, device, apparatus, component, region or section, etc., is referred to as being "directly on," "directly engaged to," "directly connected to," or "directly coupled to" another element, object, device, apparatus, component, region or section, etc., there may be no intervening elements, objects, devices, apparatuses, components, regions or sections, etc., present. Other words used to describe the relationship between elements, objects, devices, apparatuses, components, regions or sections, etc., should be interpreted in a like fashion (e.g., "between" versus "directly between," "adjacent" versus "directly adjacent," etc.).

As used herein, the term "and/or" includes any and all combinations of one or more of the associated listed items. For example, A and/or B includes A alone, or B alone, or both A and B.

Although the terms first, second, third, etc. can be used herein to describe various elements, objects, devices, apparatuses, components, regions or sections, etc., these elements, objects, devices, apparatuses, components, regions or sections, etc., should not be limited by these terms. These terms may be used only to distinguish one element, object, device, apparatus, component, region or section, etc., from another element, object, device, apparatus, component, region or section, etc., and do not necessarily imply a sequence or order unless clearly indicated by the context.

Moreover, it will be understood that various directions such as "upper", "lower", "bottom", "top", "left", "right", "first", "second" and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Figure 2:
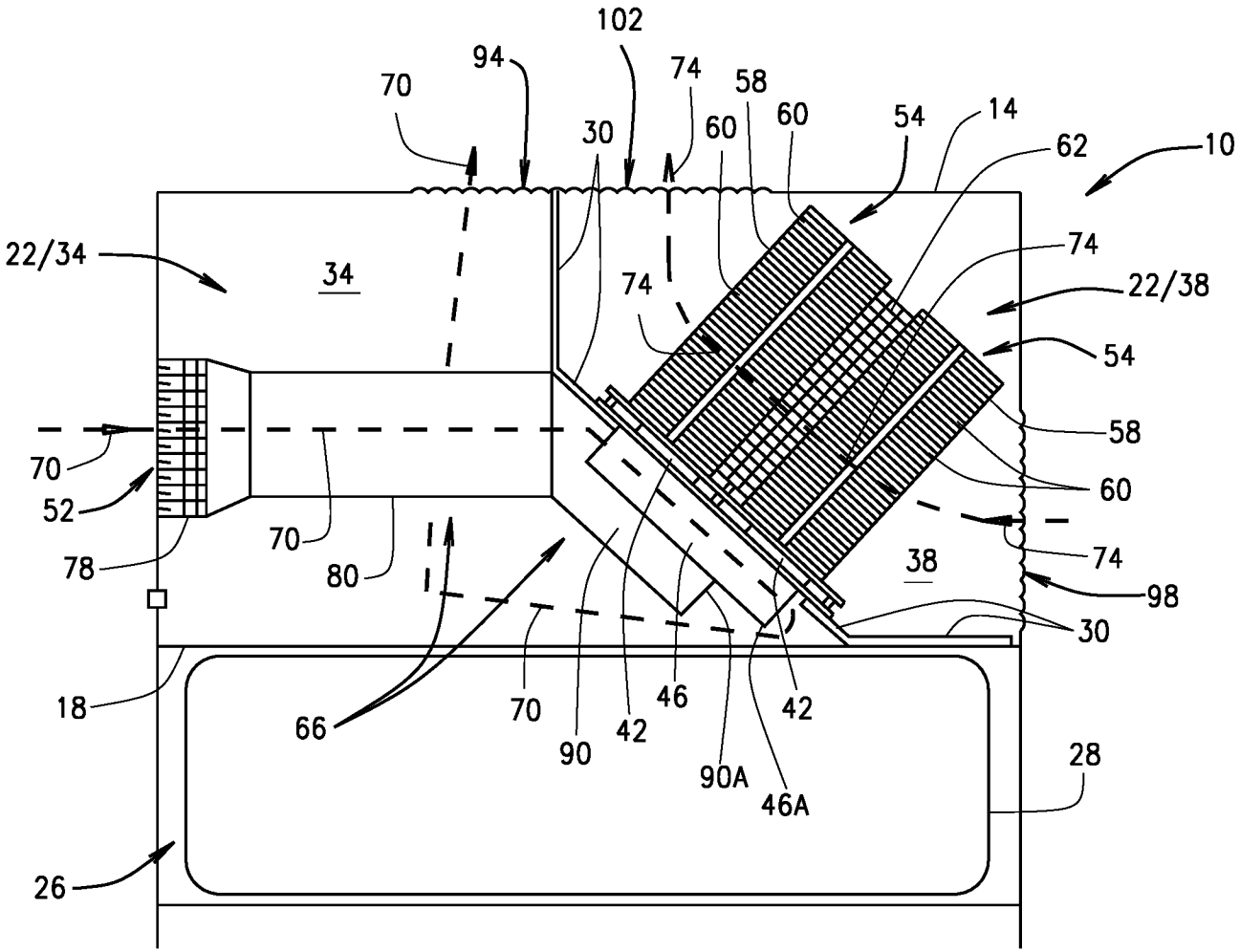
FIG. 2 is a schematic side view of the high efficiency, low noise thermoelectric dehumidifier shown in FIG. 1, in accordance with various embodiments of the present disclosure.

Referring now to FIGS. 1 and 2, the present disclosure provides a high efficiency, low noise thermoelectric dehumidifier 10 that is structured and operable to efficiently remove moisture from the ambient air surrounding the dehumidifier 10 while operating at a low noise level (e.g., 20-40 dba). The dehumidifier 10 comprises an insulated housing 14 that includes an interior bottom partition or wall 18 that divides the interior space of the housing 14 into an upper operations compartment 22 and lower condensation pan compartment 26 sized and structured to removably retain a condensation pan 28 of the dehumidifier 10. The housing 14 additionally includes an air flow partition 30 that divides the upper operations compartment into a dehumidifying chamber 34 and a heat removal chamber 38. The dehumidifier 10 additionally comprises at least one thermoelectric cooler (TEC) 42 mounted within one or more window of the air flow partition 30. Each of the one or more TEC(s) 42 is generally a solid-state active heat pump that is structured and operable to transfer heat from a cold side of the TEC(s) 42 to a hot side depending on the direction of current flowing through the TEC(s) 42. Particularly, the TEC(s) is/are mounted within the air flow partition window(s) such that the cold side faces the dehumidifying chamber 34 and the hot side faces the heat removal chamber 38. The dehumidifier further comprises at least one condensation heat sink 46 that is/are in thermally conductive contact with the cold side of the TEC(s) 42 (e.g., mounted to the cold side of the TEC(s) 42) and protrude(s) or extend(s) into the dehumidifying chamber 34. In various instances, each of the one or more condensation heat sinks 46 comprising a plurality of condensing fins 48. Still further the dehumidifier comprises at least one heat pipe array 50 that is in thermally conductive contact with the hot side of the TEC(s) 42 (e.g., mounted to the hot side of the TEC(s) 42) and protrude(s) or extend(s) into the heat removal chamber 38.

Each of the one or more heat pipe arrays 50 comprise(s) a plurality of heat pipes 54 that are structured and operable to rapidly and efficiently extract and remove heat from the hot side of the TEC(s) 42, thereby keeping the cold side of the TEC(s) 42 cold. In various instances each heat pipe 54 generally comprises an evaporator end (or heat absorption end) that is in thermally conductive contact with hot side of the TEC(s) 42, and an opposing condenser end (or heat rejection end). As is known, heat pipes, e.g., heat pipes 54, are a heat transfer mechanism that can transport large quantities of heat with a very small difference in temperature between a hot interface (e.g., the hot side of the TEC(s) 42), and a cold/cool interface (e.g., a cooling air flow 74 flowing through heat pipes 54, as described below). Specifically, heat is transferred from the evaporator ends of each heat pipe to the opposing condenser end by a rapid transition from the evaporator end to the condenser end of a heat vaporized working fluid disposed within the respective heat pipe.

More particularly, with regard to the heat pipe array(s) 50 of the present disclosure, the heat pipe array(s) 50 is/are mounted within the heat removal chamber 38 such that the evaporator ends are in thermally conductive contact (e.g., direct contact) with hot side of the TEC(s) 42. The condenser end of each heat pipe 54 extends away from the TEC(s) into the heat removal chamber 38 and will be in thermal contact with the cooling air flow 74 during operation of the dehumidifier 10, as described below. As used herein, thermally conductive contact will be understood to mean direct and/or indirect contact such that heat can be rapidly absorbed or rejected between the respective surfaces or components. It is envisioned that in various implementations, the heat pipe array(s) 50 can include one or more oscillating heat pipe.

In various embodiments, each heat pipe array 50 is disposed within a respective heat sink block or plate 58 such that the heat pipes 54 of the respective heat pipe array 50 are in thermally conductive contact the respective heat sink block 58. In various instances, each heat sink block 58 can comprise a plurality of spaced apart cooling fins 60, wherein all or a large portion of cooling fins 60 are in thermally conductive contact with one or more heat pipe 54. The cooling fins 60 are spaced apart such that the cooling air flow 74 can pass between, over and around the cooling fins 60 to rapidly and efficiently remove heat from heat pipes 54, as described below. More particularly, one or more heat extractor fan 62 is/are disposed at least partially within the heat removal chamber 38, and in various instances is disposed between, above, below, near, adjacent, or in close proximity to the heat sink block(s) and heat pipe array(s) 50. As described further below, the heat extractor fan(s) 62 are structured and operable to draw the cooling air flow 74 from the ambient environment over, through and/or across the fins of the heat sink block(s) 58 and the heat pipes 54 of the heat pipe array(s) such heat extracted from the hot side of the thermoelectric cooler(s) 42 by heat pipe array(s) 50 is extracted and removed from the heat pipe array(s) 50 and circulated back into the ambient environment surrounding the dehumidifier 10.

The dehumidifier 10 still further yet comprises an air intake duct 66 that is at least fluidly connected to an air intake duct opening 52 in the housing 14 and is structured and operable to receive a dehumidifying air flow 70 from the ambient environment surrounding the dehumidifier 10, via the air intake duct opening 52, and direct or guide the dehumidifying air flow 70 toward, through, across, around and/or over the condensing fins 48 of the condensation heat sink(s) 46. Additionally, the dehumidifier 10 includes an air intake, or condenser, fan 78 that is structured and operable to draw the dehumidifying air flow 70 into the air intake duct 66 from the ambient environment surrounding the dehumidifier 10. The dehumidifier 10 further includes a control electronics module 82 that is structured and operable to control the operation of the dehumidifier 10, for example, to control the operation of the air intake fan 78, the TEC(s) 42, and the heat extractor fan 62.

In operation, the control electronics module 82 controls a flow of electrical power to TEC(s) 42, thereby causing the cold side(s) of the TEC(s) 42 to get cold (e.g., 32°-50° F.), depending the ambient temperature and relative humidity. Since the condensing heat sink(s) 46 is in thermally conductive contact with the cold side(s) of the TEC(s) 42, the condensing heat sink(s) 46, and the condensing fins 48 will be cooled to substantially, or near, the same temperature of the cold side(s) of the TEC(s) 42 (e.g., 32°-50° F.). Additionally, the air intake fan 78 generates the dehumidifying air flow 70 by drawing humid ambient air from the ambient environment and expelling it into the air intake duct 66. The air intake duct 66, in turn, directs or guides the dehumidifying air flow 70 between, across, over and/or around the cold condensing fins 48 of the condensation heat sink(s) 46. As the dehumidifying air flow 70 passes between, across, over and/or around the cold condensing fins 48, moisture in the dehumidifying air flow 70 condenses and turns to water, which collects on the cold condensing fins 48 and falls or flows onto the bottom partition 18, which is structured to direct the water into the condensation pan 28, thereby dehumidifying the dehumidifying air flow 70. After the dehumidifying air flow 70 is dehumidified, the dehumidifying air flow 70, via the air intake fan 78, will circulate through the dehumidifying chamber 34 and exit the dehumidifying chamber 34, via a dehumidified air outlet 94 in the housing 14, and flow back into the ambient environment, thereby replacing the humid air drawn into the air intake duct 66 with dehumidified air. The water collected on the cold condensing fins 48 will accumulate and subsequently fall onto and collect on the bottom partition 18. In various embodiments, the bottom partition 18 includes a drainage system that directs the collected water into the condensation pan 28.

As described above, the TEC(s) 42 operate(s) to generate the cold side and the hot side. If the heat is not quickly and efficiently extracted from the hot side, the cold side will not be able to cool efficiently, and hence the condensation heat sink(s) 46 will not cool efficiently, and hence the dehumidifying air flow 70 will not be dehumidified efficiently. As also described above, the heat pipes 54 in the heat pipe array(s) 50 will operate to rapidly and efficiently extract and remove the heat from the hot side of the TEC(s) 42, thereby allowing the cold side of TEC(s) to cool efficiently and generate highly efficient dehumidification of the dehumidifying air flow 70. Particularly, absorption of heat from the hot side(s) of the TEC(s) 42 at the evaporator ends of the heat pipes 54 will heat the evaporator ends and cause the working fluid at the evaporator ends to turn to vapor, thereby increasing the vapor pressure inside the heat pipes. Latent heat of evaporation absorbed by the vaporization of the working fluid removes heat from the hot side(s) of the TEC(s) 42. Subsequently, the vapor pressure at the evaporator ends drives a rapid mass transfer of the heated vaporized working fluid from the evaporator ends to the condenser ends where the vapor condenses and releases its latent heat into the cooling air flow 74, thereby rapidly transferring heat from the hot side(s) of the TEC(s) 42 to the cooling air flow 74. Thereafter, the condensed working fluid flows back to the evaporator ends of the heat pipes 54 and the cycle is repeated. Accordingly, the heat is rapidly and efficiently extracted and removed from the hot side(s) of the TEC(s), thereby allowing the cold side(s) to cool efficiently and the dehumidifier 10 to dehumidify air highly efficiently.

As described above, the condenser end of each heat pipe 54 extends away from the TEC(s) into the heat removal chamber 38 and will be in thermal contact with the cooling air flow 74 during operation of the dehumidifier 10. More particularly, the heat extractor fan(s) 62 will draw the cooling air flow into the heat removal chamber 38 via an air inlet opening 98 in the housing 14 and through the spaced apart cooling fins 60 such that the cooling air flow 74 will pass between, over and around the cooling fins 60 to rapidly and efficiently remove heat from heat pipes 54, as described below, thereby rapidly and efficiently extracting and removing heat from the hot side of the thermoelectric cooler(s) 42. Thereafter, the cooling air flow 74 will exit the heat removal chamber 38 via and cooling air flow outlet 102 in the housing 14, and is circulated back into the ambient environment surrounding the dehumidifier 10.

In various embodiments, the TEC(s) 42 can be hybrid ejector-thermoelectric cooler(s) such as those described in issued U.S. Pat. No. 8,763,408, issued Jul. 1, 2014, which is incorporated herein by references in its entirety. Such hybrid ejector-thermoelectric cooler(s) utilize the thermal energy from the hot side of the respective TEC(s) to generate additional cooling of the cold side, thereby making the TEC(s) operate and cool the condensation heat sink(s) 46 more efficiently.

Referring still to FIGS. 1, 2, 3 and 4, the air intake duct 66 can have any shape, size, geometry and structure that is operable to direct and/or guide the dehumidifying air flow 70 toward, through, between, across, around and/or over the condensing fins 48 of the condensation heat sink(s) 46. As exemplarily illustrated in FIGS. 1 and 2, in various embodiments, the air intake duct 66 can be structured to comprise an air inlet portion 80 that is at least fluidly connected to the air intake duct opening 52 in the housing 14, and an air flow channel or conduit portion 90 that extends from the air inlet portion 66A and is structured and operable to direct and/or guide the dehumidifying air flow 70 toward, through, across, around and/or over the condensing fins 48 of the condensation heat sink(s) 46. In such embodiments, an egress end 90A of the air flow channel 90 terminates at or near a distal end 46A of the condensing heat sink(s) 46. Therefore, in such embodiments, the dehumidified dehumidifying air flow 70 will exit the air flow channel 90 and circulate through the dehumidifying chamber 34, around the air inlet portion 80 of the air intake duct 66, and exit the dehumidifying chamber 34 via the dehumidified air outlet 94.

Figure 3:
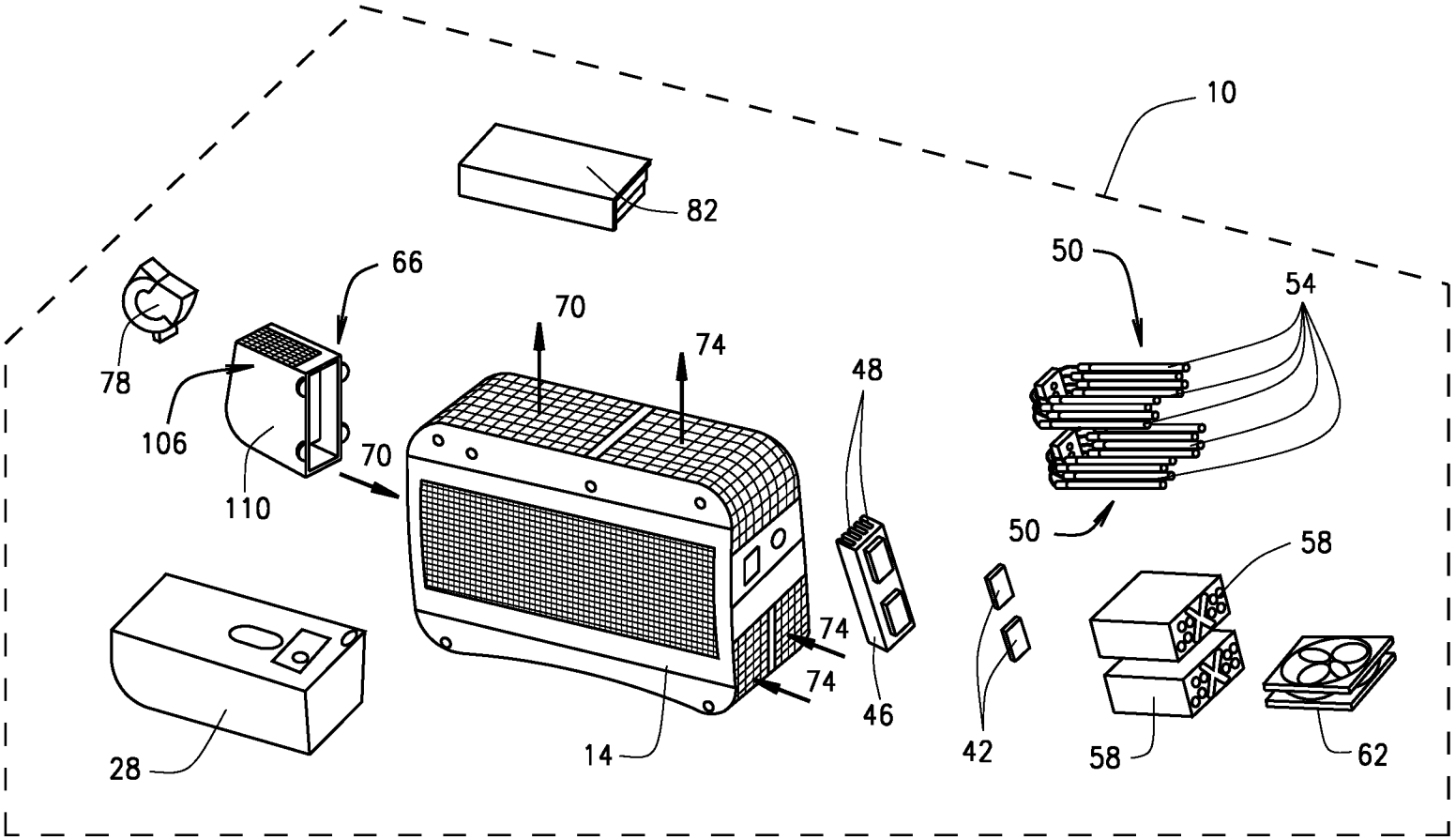
FIG. 3 is an exploded illustration of the high efficiency, low noise thermoelectric dehumidifier shown in Figure, in accordance with various other embodiments of the present disclosure.
Figure 4:
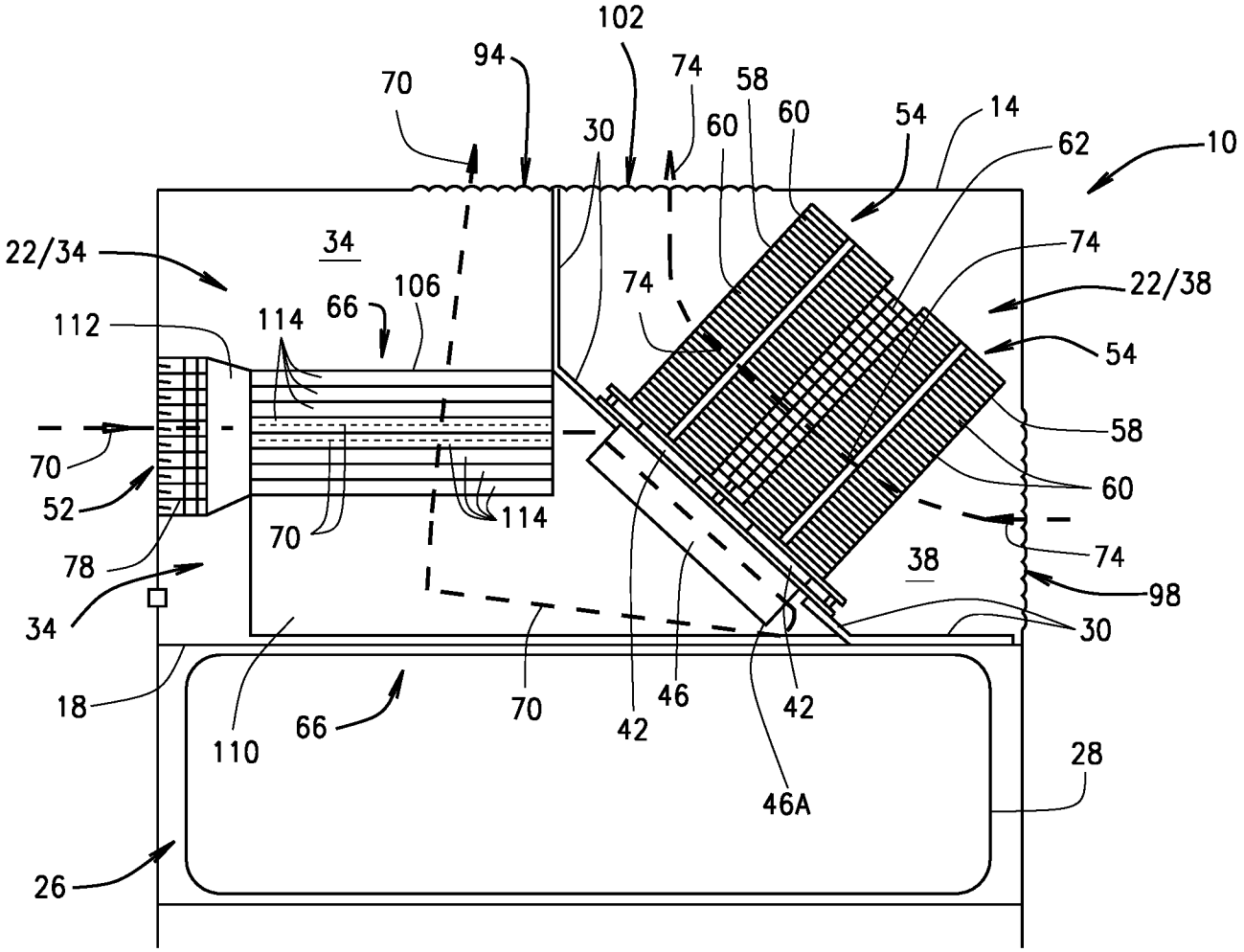
FIG. 4 is a schematic side view of the high efficiency, low noise thermoelectric dehumidifier shown in FIG. 3, in accordance with various embodiments of the present disclosure.

In various other embodiments, as exemplarily illustrated in FIGS. 3 and 4, the air intake duct 66 can be structured to provide a cooling recovery unit that is operable to pre-cool the dehumidifying air flow 70 prior to the dehumidifying air flow 70 passing through, between, across, around and/or over the condensing fins 48 of the condensation heat sink(s) 46. In such embodiments, the air intake duct 66 comprises a heat exchanging air intake conduit 106 that is structured and operable to direct or guide the dehumidifying air flow 70 toward, through, between, across, around and/or over the condensing fins 48 of the condensation heat sink(s) 46, as described above. Additionally, in such embodiments, the dehumidifying chamber 34 comprises an air recovery chamber 110 that is structured and operable to force the cooled and dehumidified air of the dehumidifying air flow 70 that has passed through, between, across, around and/or over the condensing fins 48 of the condensation heat sink(s) 46 to pass through the heat exchanging air intake conduit 106 prior to the dehumidifying air flow 70 exiting the dehumidifier 10 via the dehumidified air outlet 94, as illustrated in FIG. 4. Specifically, the heat exchanging air intake conduit 106 is structured and operable to direct or guide the humid, non-dehumidified air of the dehumidifying air flow 70 through the heat exchanging air intake conduit 106 in a first direction toward the condensation heat sink(s) 46, and is further structured and operable to allow the cooled and dehumidified air of the dehumidifying air flow 70 that has passed through, between, across, around and/or over the condensation heat sink(s) 46 to pass through the air intake conduit 106 in a second direction that intersects and crosses the first direction. Therefore, the cooled and dehumidified air of the dehumidifying air flow 70 passing through the heat exchanging air intake conduit 106 in the second/cross direction, will pre-cool the humid, non-dehumidified air of the dehumidifying air flow 70 flowing through the air intake conduit 106 in the first direction prior to the humid, non-dehumidified air passing through, between, across, around and/or over the condensing fins 48 of the condensation heat sink(s) 46.

For example, in various instances, the heat exchanging air intake conduit 106 can comprise an inlet collar 112 a plurality of spaced apart air flow tubes 114 connected to the inlet collar 112 and extending longitudinally along the length of the heat exchanging air intake conduit 106. In such instances, the inlet collar 112 is structured and operable to direct the humid, non-dehumidified air drawn in from the ambient environment by the air intake fan 78 into the air flow tubes 114 such that the humid, non-dehumidified air of the dehumidifying air flow 70 passes through the air flow tubes 114 in the first direction and is directed or guided toward the condensation heat sink(s) 46. Thereafter, the cooled and dehumidified air of the dehumidifying air flow 70 is directed or guided by the air recovery chamber 110 across and around the air flow tubes 114 and the through the spaces therebetween in the second/cross direction. As the cooled and dehumidified air passes across, around and between the air flow tubes 114 in the second/cross direction, heat from the humid, non-dehumidified air flowing through the air flow tubes 114 in the first direction is extracted by the cooled and dehumidified air, thereby pre-cooling the humid non-dehumidified air prior to the humid air passing through, between, across, around and/or over the condensing fins 48 of the condensation heat sink(s) 46. Pre-cooling the humid, non-dehumidified will increase the dehumidifying efficiency dehumidifier 10.

Generally, the heat pipe array(s) 50 used in conjunction with the TEC(s) 42 (as described above) will effectively regulate heat to and/or from the TEC(s) 42 such the dehumidifier 10 can provide a coefficient of performance (COP) that is much higher than known dehumidifiers, and therefore significantly increase the moisture removal rate from the ambient air. Additionally, by incorporating the cooling recovery air intake duct 66 (as illustrated in and described with reference to FIGS. 3 and 4), in various embodiments, the coefficient of performance (COP) of the dehumidifier 10 can be increased even more and therefore significantly increase the moisture removal rate from the ambient air even more. Furthermore, by incorporating one or more hybrid ejector-thermoelectric cooler (as described above with regard to issued U.S. Pat. No. 8,763,408) the coefficient of performance (COP) of the dehumidifier 10 can be increased yet even more and therefore significantly increase the moisture removal rate from the ambient air yet even more. For example, known dehumidifiers typically have a COP of 0.4-0.6, but the dehumidifier 10 of the present can operate at a COP of 0.6-2.5.

The description herein is merely exemplary in nature and, thus, variations that do not depart from the gist of that which is described are intended to be within the scope of the teachings. Moreover, although the foregoing descriptions and the associated drawings describe example embodiments in the context of certain example combinations of elements and/or functions, it should be appreciated that different combinations of elements and/or functions can be provided by alternative embodiments without departing from the scope of the disclosure. Such variations and alternative combinations of elements and/or functions are not to be regarded as a departure from the spirit and scope of the teachings.

What is claimed is:

1. A high efficiency, low noise thermoelectric dehumidifier, said dehumidifier comprising:

a housing;

at least one heat pipe array;

at least one condensing heat sink;

a condensation pan;

a condenser fan mounted to a wall of the housing at an intake duct opening in the wall of the housing;

an air intake duct that is a separate in independent structure from the housing and is connected to the condenser fan at an inlet of the air intake duct and extending into an interior of the housing from the wall of the housing to the at least one condensing heat sink, the condenser fan structured and operable to draw a first air flow from an ambient environment around the dehumidifier into the inlet of the air intake duct, the air intake duct structured and operable to guide the first air flow through the air intake duct to the at least one condensing heat sink such that the first air flow exits an outlet end of the air intake duct and passes at least one of over, through and across the at least one condensing heat sink;

at least one thermoelectric cooler, the thermoelectric cooler comprising:

a cooling side that is connected to and in thermally conductive contact with the at least one condensing heat sink that is structured and operable to cool and dehumidify the first air flow such that the first air flow is cooled and moisture in the first air flow will condense as the first air flow passes at least one of over, through and across the condensing heat sink and fall into the condensation pan, thereby dehumidifying the first air flow, whereafter the condenser fan will circulate the cooled and dehumidified first air flow back into the ambient environment; and a hot side that is connected to and in thermally conductive contact with the at least one heat pipe array such that heat generated by the thermoelectric cooler is extracted from the thermoelectric cooler hot side by the at least one heat pipe array; and an extractor fan structured and operable to draw a second air flow from the ambient environment at least one of over, through and across the at least one heat pipe array such that the heat extracted from the hot side of the thermoelectric cooler by the at least one heat pipe array is extracted from the at least one heat pipe array and circulated back into the ambient environment, wherein the first air flow is not in contact with the second air flow within the housing.

2. The dehumidifier of claim 1, wherein the air intake duct is a heat exchanging air intake conduit that is structured and operable to direct the first air flow therethrough in a first direction, and the heat exchanger air intake conduit comprises an air recovery chamber connected thereto and structured and operable to force the cooled and dehumidified air of the first air flow to pass through the heat exchanging air intake conduit in a second direction such that the first air flow being drawn into the air intake duct from the ambient environment will be pre-cooled prior to flowing at least one of over, through and across the condensing heat sink.

3. The dehumidifier of claim 2, wherein the heat exchanging air intake conduit comprises an inlet collar and a plurality of spaced apart air flow tubes connected to the inlet collar and extending longitudinally along the length of the heat exchanging air intake conduit, wherein the inlet collar is structured and operable to direct the first air flow into the air flow tubes such that first air flow passes through an interior of the air flow tubes in a first direction and is guided to the at least one condensing heat sink, whereafter the dehumidified first air flow passes one of across, around and between and exterior of the air flow tubes in the second direction, thereby precooling the first air flow passing through the interior of the air flow tubes in the first direction.

4. The dehumidifier of claim 1, wherein the at least one thermoelectric cooler is an ejector-thermoelectric cooler.

5. The dehumidifier of claim 1, wherein the at least one thermoelectric cooler is an ejector-thermoelectric cooler.

6. A method for removing moisture from ambient air utilizing a high efficiency, low noise thermoelectric dehumidifier, said method comprising:

drawing, via condenser fan of the dehumidifier that is mounted to a wall of a housing of the dehumidifier at an intake duct opening in the wall of the housing, a first air flow from an ambient environment around the dehumidifier into an air intake duct of the dehumidifier that is a separate and independent structure from the housing and is connected to the condenser fan at an inlet of the air intake duct and extends into an interior of the housing from the wall of the housing to a condensing heat sink of the dehumidifier that is structured and operable to cool and dehumidify the first air flow, whereafter the air intake duct guides the first air flow to the condensing heat sink of the dehumidifier;

passing the first air flow exiting an outlet end of the air intake duct at least one of over, through and across the condensing heat sink;

cooling the condensing heat sink utilizing a thermoelectric cooler having a cooling side that is connected to and in thermally conductive contact with the condensing heat sink such that the first air flow is cooled and dehumidified and moisture in the first air flow will condense as the first air flow passes at least one of over, through and across the condensing heat sink, thereby dehumidifying the first air flow;

circulating, via the condenser fan, the cooled and dehumidified first air flow back into the ambient environment;

removing heat from a hot side of the thermoelectric cooler utilizing a heat pipe array that is connected to and in thermally conductive contact with the thermoelectric cooler hot side such that heat generated by the thermoelectric cooler is extracted from the thermoelectric cooler hot side by the heat pipe array; and drawing, via an extractor fan, a second air flow from the ambient environment at least one of over, through and across the heat pipe array such that the heat extracted from the hot side of the thermoelectric cooler by the heat pipe array is extracted from the heat pipe array and circulated back into the ambient environment, wherein the first air flow is not in contact with the second air flow within the housing.

7. The method of claim 6 further comprising directing the cooled and dehumidified air across a flow path of the first air flow as the first air flow is being drawn into the air intake duct from the ambient environment utilizing an air recovery chamber that is connected to the intake duct such that the first air flow being drawn into the air intake duct from the ambient environment will be pre-cooled prior to passing the first air flow at least one of over, through and across the condensing heat sink.

8. The method of claim 7 wherein the heat exchanging air intake conduit comprises an inlet collar and a plurality of spaced apart air flow tubes connected to the inlet collar and extending longitudinally along the length of the heat exchanging air intake conduit, wherein the inlet collar is structured and operable to direct the first air flow into the air flow tubes such that first air flow passes through an interior of the air flow tubes in a first direction and is guided to the at least one condensing heat sink, whereafter the dehumidified first air flow passes one of across, around and between and exterior of the air flow tubes in the second direction, thereby precooling the first air flow passing through the interior of the air flow tubes in the first direction.

9. The dehumidifier of claim 7 wherein the air intake duct is a heat exchanging air intake conduit comprising an inlet collar and a plurality of spaced apart air flow tubes connected to the inlet collar and extending longitudinally along the length of the heat exchanging air intake conduit, wherein the inlet collar is structured and operable to direct the first air flow into the air flow tubes such that first air flow passes through an interior of the air flow tubes in a first direction and is guided to the at least one condensing heat sink, whereafter the dehumidified first air flow passes one of across, around and between and exterior of the air flow tubes in the second direction, thereby precooling the first air flow passing through the interior of the air flow tubes in the first direction.

10. The method of claim 6, wherein cooling the condensing heat sink utilizing a thermoelectric cooler comprises cooling the condensing heat sink utilizing an ejector-thermoelectric cooler.

11. A high efficiency, low noise thermoelectric dehumidifier, said dehumidifier comprising:

a housing;

an air flow partition fixedly disposed within an interior space of the housing and connected to two walls of the housing such the air flow partition divides the interior space into a dehumidifying chamber and a separate and distinct heat removal chamber such that the dehumidifying chamber and heat removal chamber are absent any fluid connection therebetween, wherein the housing comprises:

an air intake opening and a dehumidified air outlet fluidly connected to the air intake opening via the dehumidifying chamber such that a dehumidifying air flow can enter the dehumidifying chamber via the air intake opening and exit the dehumidifying chamber via the dehumidified air outlet; and an air inlet opening that is separate and distinct from the air intake opening, and a cooling flow outlet that is separate and distinct from the dehumidified air outlet, the air inlet opening fluidly connected to the cooling flow outlet via heat removal chamber such that a cooling air flow that is separated and distinct from the dehumidifying air flow can enter the heat removal chamber via the air inlet opening and exit the heat removal chamber via the cooling flow outlet;

at least one heat pipe array enclosed within the heat removal chamber;

at least one condensing heat sink disposed within the dehumidifying chamber;

a condensation pan;

a condenser fan mounted to a wall of the housing at the intake opening;

an air intake duct connected to the condenser fan at an inlet of the air intake duct and extending into an interior of the dehumidifying chamber from the wall of the housing to the at least one condensing heat sink, the condenser fan structured and operable to draw the dehumidifying air flow from an ambient environment around the dehumidifier into the dehumidifying chamber via the air inlet opening, the air intake duct structured and operable to guide the dehumidifying air flow through the intake duct to the at least one condensing heat sink that is structured and operable to cool and dehumidify the first air flow such that the dehumidifying air flow passes at least one of over, through and across the at least one condensing heat sink, circulates within the dehumidifying chamber and exits the dehumidifying chamber via the dehumidified air outlet;

at least one thermoelectric cooler, the thermoelectric cooler comprising:

a cooling side in thermally conductive contact with the at least one condensing heat sink such that the dehumidifying air flow is cooled and moisture in the dehumidifying air flow will condense as the dehumidifying air flow passes at least one of over, through and across the condensing heat sink and fall into the condensation pan, thereby dehumidifying the dehumidifying air flow, whereafter the condenser fan will circulate the cooled and dehumidified dehumidifying air flow back into the ambient environment via the dehumidified air outlet; and a hot side in thermally conductive contact with the at least one heat pipe array such that heat generated by the thermoelectric cooler is extracted from the thermoelectric cooler hot side by the at least one heat pipe array; and an extractor fan structured and operable to draw the cooling air flow from the ambient environment into the heat removal chamber via the air inlet opening and at least one of over, through and across the at least one heat pipe array such that the heat extracted from the hot side of the thermoelectric cooler by the at least one heat pipe array is extracted from the at least one heat pipe array via the cooling air flow and circulated within the heat removal chamber and back into the ambient environment via the cooling flow outlet.

12. The dehumidifier of claim 11, wherein the air intake duct is a heat exchanging air intake conduit that is structured and operable to direct the dehumidifying air flow therethrough in a first direction, and the heat exchanger air intake conduit comprises an air recovery chamber structured and operable to force the cooled and dehumidified air of the dehumidifying air flow to pass through the heat exchanging air intake conduit in a second direction such that the dehumidifying air flow being drawn into the air intake duct from the ambient environment and flowing through the heat exchanging air intake conduit will be pre-cooled prior to flowing at least one of over, through and across the condensing heat sink, wherein the first air flow is not in fluid contact with the second air flow.

* * * * *